United States Patent [19]

Rooklyn

[11] Patent Number: 4,699,677

[45] Date of Patent: Oct. 13, 1987

[54] METHOD OF MAKING AND INSTALLING CONDUCTIVE FLOOR TILE FOR CONTROL OF STATIC GENERATION

[76] Inventor: Jack Rooklyn, 19339 Citronia St., Northridge, Calif. 91324

[21] Appl. No.: 754,403

[22] Filed: Jul. 12, 1985

Related U.S. Application Data

[63] Continuation-in-part of Ser. No. 639,702, Aug. 13, 1984, which is a continuation-in-part of Ser. No. 613,088, May 22, 1984, which is a continuation-in-part of Ser. No. 286,611, Jul. 24, 1981, Pat. No. 4,456,944, which is a continuation-in-part of Ser. No. 180,962, Aug. 25, 1980, abandoned.

[51] Int. Cl.[4] ..... E04F 15/06; E04F 15/10; H05F 3/02

[52] U.S. Cl. ..... 156/71; 52/390; 52/746; 156/276; 156/297; 361/215; 361/216; 428/922

[58] Field of Search ..... 156/71, 312, 276, 297; 52/746, 747, 390; 428/922; 361/212, 216, 214, 215

[56] References Cited

U.S. PATENT DOCUMENTS

| | | | |
|---|---|---|---|
| 1,939,961 | 12/1933 | Emig | 156/312 |
| 2,173,622 | 9/1939 | Crooks | 156/71 |
| 2,325,414 | 7/1943 | McChesney | 361/216 |
| 2,457,299 | 12/1948 | Biemesderfer | 156/71 |
| 3,121,825 | 2/1964 | Abegg | 361/216 |
| 3,347,978 | 10/1967 | Simon | 156/276 |
| 4,084,031 | 4/1978 | Barsy | 428/922 |
| 4,308,568 | 12/1981 | Whewell | 428/922 |

FOREIGN PATENT DOCUMENTS

| | | | |
|---|---|---|---|
| 14171 | 5/1973 | Japan | 156/71 |

*Primary Examiner*—Donald E. Czaja
*Assistant Examiner*—J. Davis
*Attorney, Agent, or Firm*—Evanns & Walsh

[57] ABSTRACT

An article of manufacture which is a conductive floor tile for control of generation of static electricity and method of installation. The tile includes a thin, hard layer of plastic material having bonded to it a lamination which is an electrically conductive mesh screen which is bonded to the top surface lamination by an electrically conductive adhesive. The product is a tile, the tiles being adapted for being bonded to a surface adjacent to each other with electrically conductive strips positioned beneath the joints between adjacent tiles to provide electrical continuity. The method includes the fabrication of the tiles and the steps in the installation of the tiles as described by being bonded to a surface or subsurface. The product may be fabricated with a thin layer of adhesive on the underside of the wire mesh screen covered by a layer of backing material, such as paper, which can be removed to allow the tile to be bonded to a surface as an individual tile or in accordance with the method as referred to.

2 Claims, 9 Drawing Figures

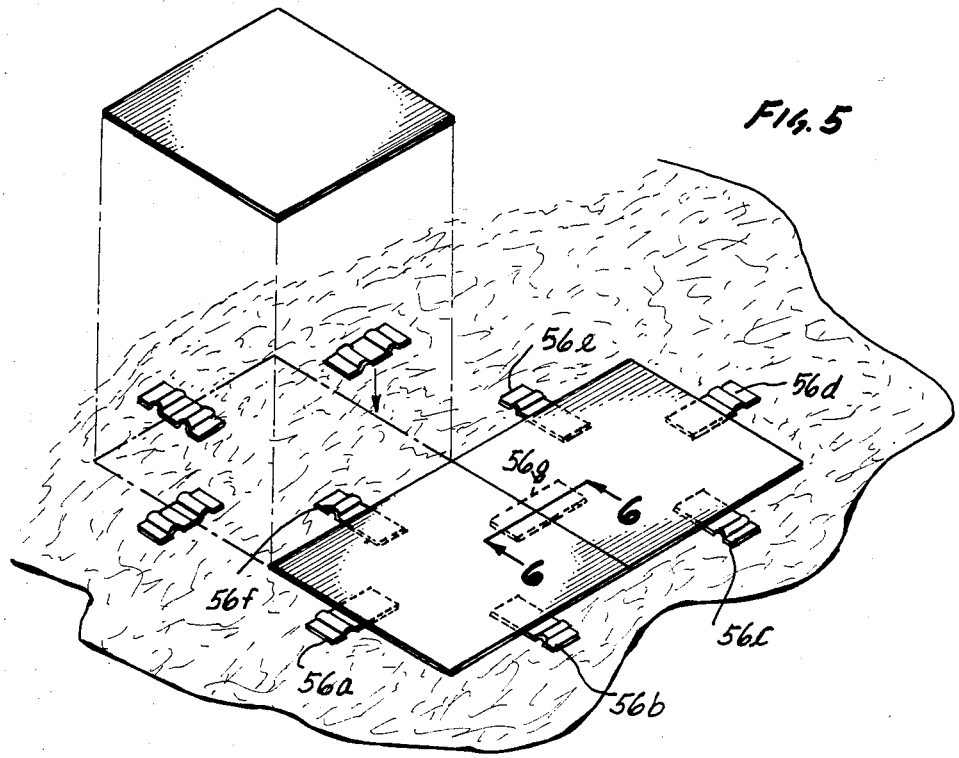
Fig. 5
Fig. 6
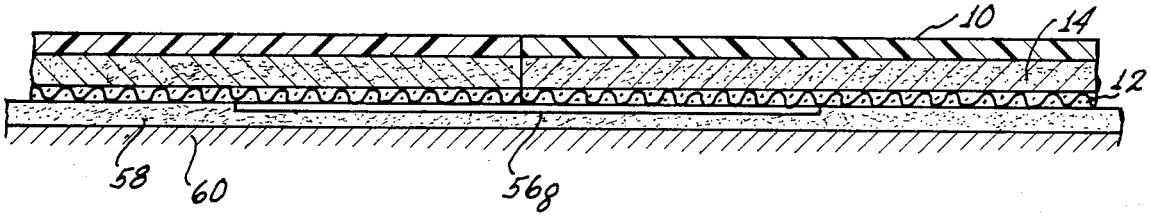
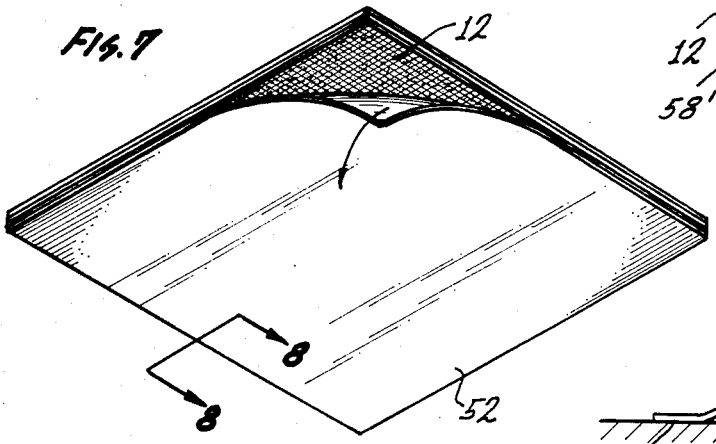
Fig. 7
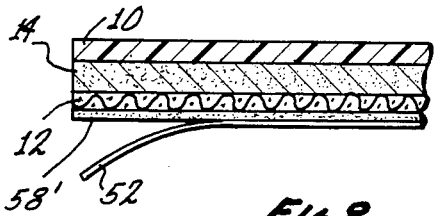
Fig. 8
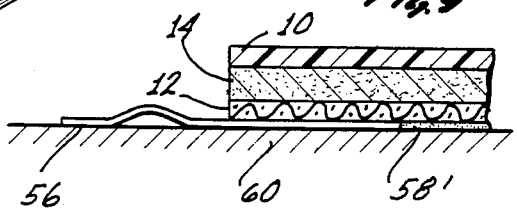
Fig. 9

METHOD OF MAKING AND INSTALLING CONDUCTIVE FLOOR TILE FOR CONTROL OF STATIC GENERATION

This is a continuation-in-part of application Ser. No. 06/639,702 filed on Aug. 13, 1984, which is a continuation-in-part of application Ser. No. 06/613,088 filed May 22, 1984, which is a continuation-in-part of application Ser. No. 06/286,611 filed on July 24, 1981, now U.S. Pat. No. 4,456,944 which is a continuation-in-part of Ser. No. 06/180,962 filed Aug. 25, 1980, now abandoned.

BACKGROUND OF THE INVENTION

1. Field of the Invention

The field of the invention is that of a product in the form of conductive floor tiles or covering which makes it possible to completely cover a floor with conductive material capable of dissipating static generation and accumulation on the product and a method of installation.

2. Description of the Prior Art

A problem has existed in the prior art which is the accumulation of static charges which can be generated on a surface and, more particularly, with reference to a floor of a technical area. Static charges accumulated on a surface or otherwise can have a deleterious effect on sensitive electronic components and can even destroy them. It is desirable to have available a floor material or floor covering from which a static charge can be drained off and yet which has the necessary characteristics to withstand all the service and impacts that a floor may be subject to.

Particularly, there has been a need for a type of installation wherein a floor can be completely covered with material or covering or tiling in such a way that a static charge can be readily dissipated or drained off. Thus, there is a need for a material or product capable of easy installation and which is effective for its purpose and which is economical to fabricate and to install.

It has been known in the prior art to provide a form of plastic tile or covering which is impregnated with carbon fiber, the fiber being impregnated into the material which is originally in liquid form. The disadvantage of this type of product is that it is difficult, if not impossible, to keep the fiber material uniformly distributed in the liquid vinyl plastic with the result that areas of the finished product may have different degrees of time rate of electrical dissipation. This product requires an electrically conductive adhesive for attaching the tiles to the floor, and copper strips must be laid on the floor in addition to the adhesive. There has been a need for a product having the characteristics as described in the foregoing, as well as having the capability or a characteristic that the rate of decay of static charge is adequate and sufficiently uniform.

The herein invention as described in detail hereinafter provides for a product and a method of installation of the product which meets all of the characteristics needed, as set forth in the foregoing.

SUMMARY OF THE INVENTION

The invention is a product which is more specifically described hereinafter. It is a conductive floor tile with characteristics of which, and the utility of which, will be made clear hereinafter.

The product is known commercially as "R-LYN" conductive floor tile.

The generation of static electrically in a floor in a plant, such as for example one wherein electronic components are manufactured or assembled, the static charge generated may damage or degrade sensitive electronic components. The primary source of static generation is the movement of personnel and/or equipment across the floor. This type of repeated action across the floor can generate significant static potentials which when discharged may damage or degrade sensitive electric components as referred to. The product of the herein invention controls the static generation by personnel and equipment and safely dissipates static charges that come into contact with it.

Basically, the conductive floor tile of the invention is made up of a grade of high pressure laminate which is a melamine plastic that is commercially available with an aluminum wire grid bonded to the rear surface, the product being designed for flooring where static protection, durability against high wear, impact resistance, and ease of maintenance are important. It provides that a surface that never needs sealing, waxing or mechanical buffing.

The conductive floor tile product is manufactured or fabricated, as described more in detail hereinafter, to exceed the requirements of NEMA (National Electrical Manufacturers Association) Publication E3-1980. The product, as made clear hereinafter, complies with the NFPA (National Fire Protection Association), No. 56, dated 1968, Section 2522, modified as outlined in the table appearing hereinafter.

The conductive floor tile product of the invention is preferably bonded to a solid subfloor with a moisture resistant adhesive, as described more in detail hereinafter. Preferably, each conductive floor tile is connected to each adjoining tile with an aluminum strip to maintain electrical continuity. One aluminum strip is extended beyond the tile perimeter attached to a suitable ground.

Preferably, the product as described is fabricated in sizes, such as for example 12 inch×12 inch tiles. Any size up to 48 inches by 96 inches can readily be made available.

To fully understand the nature of the product of the invention, the following data is presented. The average decay rate of 5,000 volts of static charge is 0.07–0.08 seconds. With respect to electrical propensity, that of leather soles is 350 volts; that of rubber soles, 900 volts.

The conductive floor tile product, as described herein, is resistant to most organic solvents, such as alcohol, acetone, ketone (MEK), lacquer thinner, paint solvent, etc.

In light of the foregoing, a primary object of the invention is to provide and make available a product which is a conductive floor tile having the capability of discharging static potentials that may be generated, which may be significant enough to otherwise damage or degrade sensitive electrical components, for example. It is a corollary to this object to provide a product which is relatively easy to fabricate; which is very effective for its purpose; and which is economical and easy to install.

It is a further object to realize a product as in the foregoing which is clean room safe, not subject to carbon contamination, and is easy to clean.

A further object is to realize a conductive laminate product, as referred to, which is easily cleaned in lowtraffic areas by damp mopping with water and mild multi-purpose organic degreaser, or the equivalent, in a mixture of, for example, eight ounces per gallon of water.

A further object of the invention is to realize and make available a floor covering material, preferably in the form of tiles, and a method of installation which is capable of achieving the purpose of providing a surface from which static charges can be dissipated readily and at a desired rate.

A further object is to realize a product in the form of a tile which is a laminated product having a hard surface lamination of plastic having electrically conductive wire mesh screen adhered to it by way of an electrically conductive adhesive.

A further object is to realize and provide a method of installation of an electrically conductive floor covering which includes the steps of providing electrically conductive floor tiles which are thin and flat and of suitable size, applying the tiles to a floor, bonding the tiles to the floor with adhesive, and providing electrical connections between adjacent tiles, preferably by way of placing electrically conductive metal strips underneath adjacent tiles to provide electrical contact between the electrically conductive laminations of the tiles.

BRIEF DESCRIPTION OF THE DRAWINGS

FIG. 5 is a schematic, isometric, illustrative view illustrating the method of installation of the product;

FIG. 6 is a cross-sectional illustrative view taken along the line 6—6 of FIG. 5, illustrating a joint between tiles in the installed surface;

FIG. 7 is an isometric view of a modified form of the product which includes a removable paper backing with adhesive for adhering to a surface;

FIG. 8 is a partial sectional view of the product of FIG. 7; and

FIG. 9 is a cross-sectional view of an end part of the product as illustrated in FIGS. 2 through 6, illustrating the installation of a tile over an electrically conductive strip.

DESCRIPTION OF A PREFERRED EMBODIMENT AND MODE OF OPERATION

Figure 1:
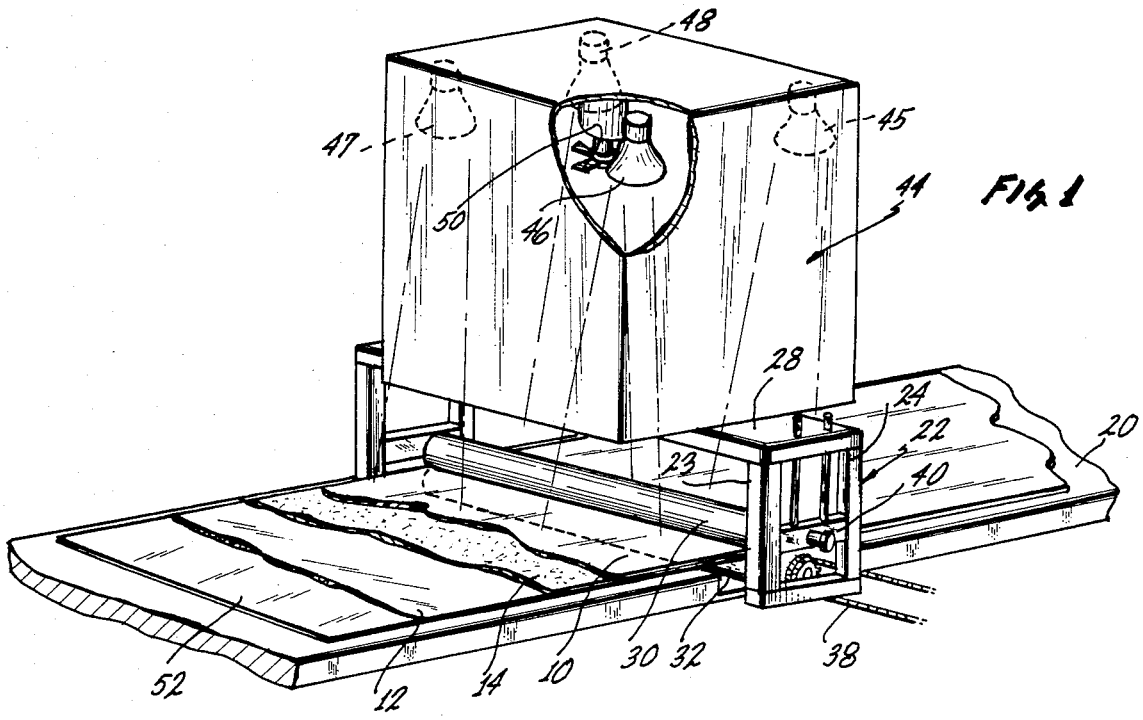
FIG. 1 is a schematic, isometric view of equipment for use in fabricating the product of the invention.

FIG. 1 of the drawings is a schematic illustrative view of apparatus for fabricating the tile product and illustrating the laminations. It will be referred to again presently.

Figure 2:
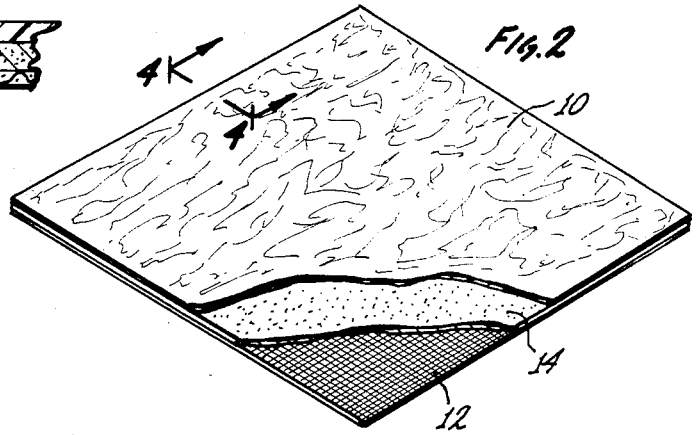
FIG. 2 is an isometric view of a single tile with laminations broken away to illustrate the structure.

A specific example of a preferred form of the product is described hereinafter with reference to the figures. FIG. 2 of the drawings is an enlarged view illustrating a preferred form of the product. In the form of the product shown, it is approximately 1/16 of an inch thick. It comprises a layer or a lamination of a plastic melamine product which is of a grade having a relatively hard or harder wear surface. This is a commercially available product. This layer is identified by the numeral 10. As stated, this is a commercial product which is a standard product consisting of the melamine sheet bonded to one side of a sheet of paper. There may be several sheets of impregnated Kraft paper, and one side of the melamine sheet has a substrate. These sheets are bonded to the melamine plastic sheet by pressure. The product is available from various commercial sources.

Numeral 12 identifies an aluminum wire grid which is bonded to the back of the melamine sheet by an electrically conductive adhesive 14. The aluminum wire grid can be of various gauges of mesh, the finished product as stated being approximately 1/16 of an inch in thickness.

The conductive adhesive 14 which attaches the aluminum mesh grid to the back of the melamine lamination is prepared particularly for this purpose. Commercially available conductive adhesives were not suitable for the purpose, because generally or typically they are made with a carbon base which gives rise to a disadvantage or drawback as described in the foregoing. The disadvantages or drawbacks of the carbon are that the carbon will attack silver; the carbon cannot be used in a clean room since it will contaminate the atmosphere; and eventually, it will dissipate into the atmosphere and lose its conductivity. The adhesive identified by the numeral 14 is made from originally a standard water-based adhesive, that is, contact cement that is commercially available. This can be any of various commercially available adhesives or contact cements known in the art for use with products, such as plastic laminate, wood, plywood, wallboard, wood veneer, etc. This could be the product known as "Fast Bond 30" or "SCOTCH-GRIP" made by 3M. Added to this product is electrolytic copper in powder form which is 99.7 percent pure copper. This material is of 100 mesh or less. It is referred to as electrolytic copper when purchased. The amount of electrolytic copper can vary, however, from one ounce per half gallon of water-based adhesive to seven ounces per half gallon, which is a preferred mixture. It is necessary to provide continuous agitation to keep the electrolytic material suspended in the adhesive or glue during applying.

The product as thus described has all of the characteristics and attributes as described in the foregoing.

The characteristics of the product can best be appreciated from the following table which illustrates a comparison of the characteristics of the product with the standards set by the Electrical Manufacturers Association.

| TEST | NEMA | R-LYN CONDUCTIVE FLOOR TILE |
|---|---|---|
| Wear Resistance | 3000 Cycles | 4000 Cycles |
| Stain Resistance | | |
| Reagents 1–23 | No Effect | No Effect |
| Reagents 24–29 | Moderate Effect | Moderate Effect |
| Scuff Resistance | No Effect | No Effect |
| Impact Resistance | 35 Inches | Over 60 Inches |
| Light Resistance | Slight Effect | No Effect |
| Conductive Heat Resistance | No Effect | No Effect |
| Cleanability | 25 Cycles Max. | 15 Cycles Max. |
| Radiant Heat Resistance | 150 Seconds | 250 Seconds |

With respect to wear resistance, cycles has reference to movements across the surface to effect wear. The reagents referred to are those identified in appropriate publications. Scuff resistance has relation to the ability of the product to withstand scuffing or kicking. Impact resistance has reference to the effect of dropping a predetermined weight onto the surface. Conductive heat resistance has reference to the transmission of heat through the product. Cleanability has reference to the cycles of cleaning movements back and forth over the surface of the product. Radiant heat resistance has reference to the number of seconds for radiant heat to have an effect on the product.

Referring again to FIG. 1 which illustrates apparatus for fabricating the product, numeral 20 illustrates a table or a platform over which the fabrication, that is, the laminating, may be done. Numeral 22 designates a frame having upright legs, including the legs 23 and 24, and similar legs at the opposite end which support a platform as designated at 28.

Numerals 30 and 32 designate a pair of rollers which are pinch rollers between which the laminations are passed and bonded together. The roller 32 is in a slot formed in the platform 20 and extends about a quarter of an inch through the slot and is tangent to, or closely adjacent to, the roller 32. The bottom roller 32 is mechanically driven through a chain as indicated by the numeral 38. The spacing between the rollers can be adjusted by way of an adjustable member 40 which is well-known in the art and need not be described in further detail.

The platform 28 supports a housing or enclosure 44. Within the enclosure are heat lamps 45, 46, 47 and 48, preferably at the corners, and which can cause heated air to pass downwardly through holes in the platform 28 and onto the laminations passing between the rollers 30 and 32. Numeral 50 designates a motor driven fan within the enclosure 44 which blows the air down through the platform 28 and onto the laminations being bonded together.

The applied temperature may be in the range of 150° F. to 180° F. The pressure applied is preferably on the order of 500 to 700 pounds per square inch.

Figure 4:
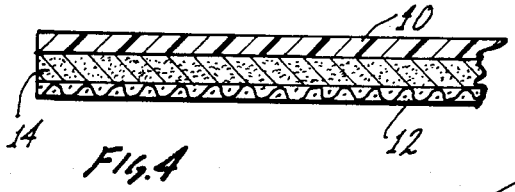
FIG. 4 is a partial enlarged sectional view of the tile product.
Figure 3:
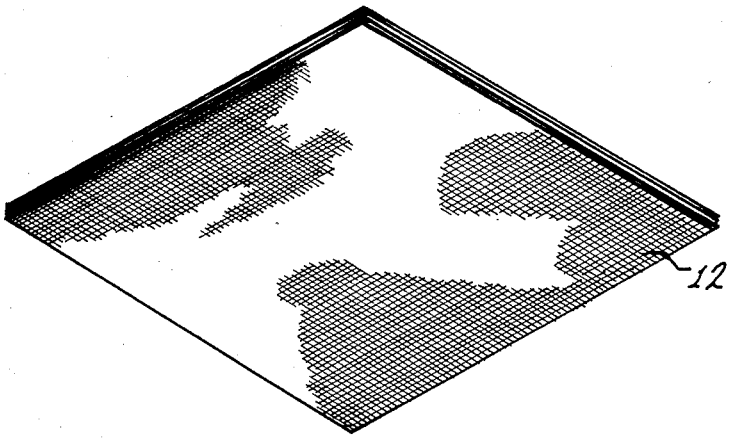
FIG. 3 is an isometric view of the side of the product opposite to that of FIG. 2.

FIG. 1 shows the laminated product with laminations broken away, the laminations being those previously described in connection with FIGS. 2–4. FIG. 1 shows an additional lamination which is a paper-backing sheet identified by the numeral 52 which can be bonded to the underside of the mesh screen by an adhesive and which can be pulled off to allow the product to be then bonded to a surface. The product can be fabricated without sheet 52.

As indicated, the product can readily be manufactured in desired sizes, such as 12 inch×12 inch tiles, or in sizes of 48 inches×96 inches. In the utilization of the tiles, they are bonded to a solid floor or subfloor with a moisture-resistant adhesive in accordance with recommendations provided by the adhesive manufacturer. FIG. 5 shows a typical installation of tiles bonded to a floor. Numerals **56*a*–56*g*** designate aluminum strips which are placed beneath the tiles at joints to provide an electrical continuity between adjacent tiles. Preferably, the strips originally have a wave in them and flatten out when the tiles are bonded to the floor. One aluminum strip can be extended beyond the tile perimeter and attached to a suitable ground.

From the foregoing, it will be appreciated that the installation as described will serve to discharge static generated in personnel and equipment, the static being dissipated safely through the tiles of the installation. The installation is relatively simple and can be done by any floor contractor.

FIG. 6 of the drawings is a cross-sectional view at line 6—6 of FIG. 5 illustrating the product as a self-adhesive conductive floor tile. The product is provided with a permanent bond self adhesive back provided by adhesive 58. The conductive floor tile is set in place on surface 60 by positioning the aluminum spring connectors **56*a*–56*b*** to maintain the electrical continuity between the adjacent tiles.

FIGS. 7, 8 and 9 illustrate a slightly modified form or application of the invention. FIGS. 8 and 9 show a part of a tile in cross-section which is like that of the previous FIGS. 1 through 6. However, a relatively thin layer of adhesive 58' is provided on the tile on the underside of the conductive mesh screen 12, and adhered to this layer or lamination of adhesive is a cover sheet 52 which may be a sheet of paper that can be pulled off. The sheet 52 is shown in the fabrication process, FIG. 1, the layer of adhesive 58' not being shown in FIG. 1. The sheet 52 can be pulled off as illustrated in FIG. 7, and then the tile can be applied to a surface as shown at 60 with conductive strips 56 in place as illustrated by the numeral 56 in FIG. 9, the adhesive 58' providing bonding to the surface 60.

This form of the product is ideal for large rooms or small areas where a static dissipative floor is desired or necessary, such as areas in front of work stations where floor pads are in use and have a tendency to move or curl up at the edges.

The foregoing disclosure is representative of preferred forms of the invention and has to be interpreted in an illustrative rather than a limiting sense, the invention to be accorded the full scope of the claims appended hereto.

I claim:

1. A method of providing an installation of floor covering capable of dissipating static electrical charges at a decay rate of substantially 5000 volts of charge in substantially 0.07–0.08 seconds including the steps of forming individual thin static dissipative tiles by forming a hard plastic surface lamination of melamine, bonding thin wire mesh screen to the hard surface lamination, placing the tiles closely adjacent to each other on a floor and bonding them to the floor by way of a floor adhesive, and providing for electrical connection between tiles over the entire surface by the step of placing electrical connectors underneath the joints between adjacent tiles in contact with the wire mesh screen of adjacent tiles and providing a grounding connection whereby static charges generated on the floor surface are dissipated at the said decay rate, forming the tiles in a generally rectangular shape, positioning a plurality of similar tiles contiguously adjacent to each other, placing electrically conductive members in the adhesive and beneath joints between adjacent tiles to provide electrical conductivity between electrically conductive laminations of the tiles whereby the entire floor covering has the capability of dissipating static charges before they can build up and extending one of the said electrical conductors beyond the perimeter of the tiles and attaching it to a suitable ground, forming the electrical connectors from aluminum, providing wave formations in the conductors and providing pressure against the tiles whereby to flatten out the wave formations in the connectors during installation to insure electrical connection between electrically conductive laminations of adjacent tiles.

2. A method of providing an installation of floor covering capable of dissipating static electrical charges at a decay rate of substantially 5000 volts of charge in substantially 0.07–0.08 seconds including the steps of forming individual thin static dissipative tiles by forming a hard plastic surface lamination of melamine, bonding thin electrically conductive wire mesh screen to the hard surface lamination, placing the tiles closely adjacent to each other on a floor and bonding them to the floor by way of a floor adhesive, and providing for electrical connection between tiles over the entire surface by the step of placing electrical connectors underneath the joints between adjacent tiles in contact with the wire mesh screen of adjacent tiles and providing a grounding connection whereby static charges generated on the floor surface are dissipated at the said decay rate, bonding the wire mesh screen to the hard surface lamination by applying a water-based adhesive, including suspending electrolytic copper in powder form in the adhesive, providing continuous agitation of the adhesive whereby to keep the electrolytic material suspended in the adhesive during application, bonding the relatively hard surface lamination and the electrically conductive screen and adhesive together under conditions of pressure and heat, forming the tiles in a generally rectangular shape, positioning a plurality of similar tiles contiguously adjacent to each other, placing electrically conductive members in the adhesive and beneath joints between adjacent tiles to provide electrical conductivity between the electrically conductive laminations of the tiles whereby the floor covering has the capability of dissipating static charges before they can build up and extending one of said electrical conductors beyond the perimeter of the tiles and attaching it to a suitable ground, forming the electrical connectors from aluminum, providing wave formations in the conductors, providing pressure against the tiles, whereby to flatten out the wave formations in the connectors during installation to ensure electrical connection between the electrically conductive laminations of adjacent tiles.

* * * * *